US009701147B2

(12) United States Patent
Miyamachi et al.

(10) Patent No.: US 9,701,147 B2
(45) Date of Patent: Jul. 11, 2017

(54) RECORDING MEDIUM WITH ENHANCED FLEXIBILITY

(71) Applicant: CANON KABUSHIKI KAISHA, Tokyo (JP)

(72) Inventors: Naotoshi Miyamachi, Tokyo (JP); Tetsuro Noguchi, Hachioji (JP); Shinya Yumoto, Kawasaki (JP); Hisao Kamo, Ushiku (JP); Kazuhiko Araki, Kawasaki (JP); Ryo Taguri, Sagamihara (JP); Takashi Sugiura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/056,865

(22) Filed: Feb. 29, 2016

(65) Prior Publication Data

US 2016/0257154 A1 Sep. 8, 2016

(30) Foreign Application Priority Data

Mar. 2, 2015 (JP) ..... 2015-040474
Feb. 22, 2016 (JP) ..... 2016-031241

(51) Int. Cl.
*B41M 5/00* (2006.01)
*B41M 5/52* (2006.01)
*B41M 5/50* (2006.01)

(52) U.S. Cl.
CPC ..... *B41M 5/52* (2013.01); *B41M 5/502* (2013.01); *B41M 5/506* (2013.01); *B41M 5/508* (2013.01); *B41M 5/5218* (2013.01); *B41M 5/5254* (2013.01)

(58) Field of Classification Search
CPC ..... B41M 5/502; B41M 5/506; B41M 5/508; B41M 5/5218; B41M 5/5254
See application file for complete search history.

(56) References Cited

U.S. PATENT DOCUMENTS

2003/0021964 A1* 1/2003 Kaneko ..... B41M 5/52 428/195.1
2003/0044586 A1* 3/2003 Nojima ..... B41M 5/506 428/195.1
2005/0174414 A1* 8/2005 Yoshida ..... B41M 5/52 347/105
2011/0298879 A1* 12/2011 Asao ..... B41M 5/00 347/105

FOREIGN PATENT DOCUMENTS

| | | | |
|---|---|---|---|
| JP | S6110483 | A | 1/1986 |
| JP | 1993-16015 | B2 | 3/1993 |
| JP | H07232473 | A | 9/1995 |
| JP | H08132731 | A | 5/1996 |
| JP | 09-066664 | A | 3/1997 |
| JP | 09-076628 | A | 3/1997 |
| JP | 2004314321 | A | 11/2004 |
| JP | 2008183807 | A | 8/2008 |

OTHER PUBLICATIONS

Chemtex, Sumika Chemtex Co., LTD. 2004.*

* cited by examiner

*Primary Examiner* — Betelhem Shewareged
(74) *Attorney, Agent, or Firm* — Canon U.S.A., Inc., IP Division

(57) ABSTRACT

A recording medium includes a substrate and an ink receiving layer that includes inorganic particles and a binder. The inorganic particles include at least one type of alumina particles selected from fumed alumina particles and hydrated alumina particles. The binder includes a resin having a glass transition temperature of 20° C. or less. The content of the binder in the ink receiving layer is 25% by mass or more of the content of the inorganic particles included in the ink receiving layer.

3 Claims, No Drawings

RECORDING MEDIUM WITH ENHANCED FLEXIBILITY

BACKGROUND

Field of the Disclosure

The present disclosure relates to a recording medium.

Description of the Related Art

There has been a growing demand for photo books and the like that include ink-jet recording media. Photo books are generally made by, for example, folding in half each of a plurality of ink-jet recording media each including an image recorded on one side thereof and bonding the other side of each recording medium, on which an image is not recorded, to one another by using the fold line as a page boundary. This method makes it possible to make a photo book by arranging on a recording medium a large image that spans a page boundary.

However, when each of the recorded media is folded, parts of the images are likely to crack or detach due to, for example, cracking of ink receiving layers included in the recording media (hereinafter, this phenomenon is referred to as "fold cracking"). Even in a case other than the production of photo books in which the recording media are intentionally folded, cracking or detachment of parts of the images may also occur due to the recording media being accidentally folded when being stored. Accordingly, there has been a growing demand for the development of a recording method that enables a recorded medium on which an image is less likely to crack or detach when being intentionally or accidentally folded, that is, a recorded medium having high resistance to fold cracking (hereinafter, referred to as "fold crack resistance"), to be produced.

One of the approaches to enhance the fold crack resistance of recorded media is to enhance the flexibility of an ink receiving layer. Japanese Patent Laid-Open No. 2004-314321 disclosed a method in which resin particles prepared by emulsion polymerization using a polymeric dispersant including a hydroxyl group are added to an ink receiving layer in order to enhance the flexibility of the ink receiving layer. Japanese Patent Laid-Open No. 2008-183807 discloses another approach to enhance the fold crack resistance of recorded media, in which an intermediate layer including a resin having a glass transition temperature of 50° C. or less is interposed between an ink receiving layer and a substrate included in a recording medium.

SUMMARY

Accordingly, the present disclosure provides a recording medium including a substrate and an ink receiving layer found on the substrate, the ink receiving layer including inorganic particles and a binder. The inorganic particles include at least one type of alumina particles selected from fumed alumina particles and hydrated alumina particles. The binder includes a resin having a glass transition temperature of 20° C. or less. The content of the binder in the ink receiving layer is 25% by mass or more of the content of the inorganic particles included in the ink receiving layer (hereinafter referred to as the first embodiment).

The present disclosure also provides a recording medium including a substrate and an ink receiving layer found on the substrate, the ink receiving layer including inorganic particles and a binder. The inorganic particles include at least one type of alumina particles selected from fumed alumina particles and hydrated alumina particles. The binder includes a water-soluble resin (1) and a resin (2) having an average particle diameter of 0.3 μm or more and an elongation of 550% or more. The total amount of the resin (1) and the resin (2) included in the ink receiving layer is 20% by mass or more and 50% by mass or less of the content of the alumina particles included in the ink receiving layer (hereinafter referred to as the second embodiment).

Further features of the present disclosure will become apparent from the following description of exemplary embodiments.

DESCRIPTION OF THE EMBODIMENTS

The inventors of the present disclosure conducted studies and found that the fold crack resistance of the recording media described in Japanese Patent Laid-Open Nos. 2004-314321 and 2008-183807 had been improved but had not yet reached a level required by the present disclosure. In other words, cracking was likely to occur in the recording media when the recording media were intentionally folded as in the production of photo books.

The present disclosure provides a recording medium having high fold crack resistance.

The present disclosure is described in detail below with reference to embodiments thereof.

The inventors of the present disclosure conducted studies and, as a result, found that the fold crack resistance of a recording medium may be improved when the recording medium includes a substrate and an ink receiving layer on the substrate, the ink receiving layer including inorganic particles and a binder, the inorganic particles including at least one type of alumina particles selected from fumed alumina particles and hydrated alumina particles, the binder including a resin having a glass transition temperature of 20° C. or less, the content of the binder in the ink receiving layer (i.e., total content of the resin having a glass transition temperature of 20° C. or less and other resins included in the binder) being 25% by mass or more of the content of the inorganic particles included in the ink receiving layer.

Although the mechanisms by which the fold crack resistance of the above-described recording medium according to an embodiment of the present disclosure is improved have not been perfected, inventors provide that the fold crack resistance of the recording medium is improved due to the following reason.

Adding the soft resin having a glass transition temperature of 20° C. or less to an ink receiving layer enhances the flexibility of the ink receiving layer. Setting the total content of a binder including the soft resin to 25% by mass or more enables the resin having a glass transition temperature of 20° C. or less to increase the flexibility of the ink receiving layer in a sufficient manner. As a result, the fold crack resistance of the recording medium may be advantageously improved.

The inventors also found that the fold crack resistance of a recording medium may be improved when the recording medium includes a substrate and an ink receiving layer including inorganic particles and a binder, the inorganic particles including at least one type of alumina particles selected from fumed alumina particles and hydrated alumina particles, the binder including a water-soluble resin (1) and a resin (2) having an average particle diameter of 0.3 μm or more and an elongation of 550% or more, the total amount of the resin (1) and the resin (2) included in the ink receiving layer being 20% by mass or more and 50% by mass or less of the content of the alumina particles included in the ink receiving layer. The inventors also found that the fold crack resistance of the above-described recording medium may be maintained even when the recording medium is folded repeatedly.

Although the mechanisms by which the fold crack resistance of the above-described recording medium according to another embodiment of the present disclosure is improved have not been perfected, inventors provide that the fold crack resistance of the recording medium is improved due to the following reason.

Adding the resin (2) having an average particle diameter of 0.3 μm or more and an elongation of 550% or more to an ink receiving layer enhances the elasticity of the ink receiving layer.

Setting the total amount of the resins (1) and (2) included in the ink receiving layer to 20% by mass or more and 50% by mass or less of the content of the alumina particles included in the ink receiving layer enhances the flexibility and stretchability of the entire ink receiving layer and the adhesion of the ink receiving layer to the substrate. As a result, the fold crack resistance of the recording medium may be advantageously improved.

Recording Medium

The recording medium according to the embodiment includes a substrate and an ink receiving layer. The recording medium according to the embodiment may be a recording medium used in an ink-jet recording method, that is, an ink-jet recording medium.

The arithmetic average surface roughness Ra of the recording medium according to the embodiment specified in JIS B 0601:2001 is preferably 0.8 μm or more and 2.5 μm or less. When the arithmetic average surface roughness Ra of the recording medium according to the embodiment is measured, measurement length is set to 2.5 mm and cutoff value is set to 0.8 mm.

Setting the arithmetic average surface roughness Ra of the recording medium according to the embodiment to be within the above range may further reduce occurrence of "fogging" described below. Fogging and the mechanisms by which the occurrence of fogging is reduced are described below.

When a plurality of recorded media prepared by forming an image on recording media with an ink are stored such that the surfaces of the recorded media on which the image is recorded come into contact with one another, parts of the images formed on the recording media may be washed out (hereinafter, this phenomenon is referred to as "fogging"). Fogging is particularly likely to occur in the production of photo books. Fogging is presumably caused by an aqueous medium that is derived from the ink and remains inside the image, such as water or a water-soluble organic solvent, migrating into the adjacent image. Setting the arithmetic average surface roughness Ra of the recording medium to be within the above range reduces the area of the region in which the surfaces of the recorded media on which the images are recorded are brought into contact with one another. This may reduce the occurrence of fogging.

The arithmetic average surface roughness Ra of the recording medium may be controlled by, for example, pressing a roller having a specific degree of irregularities against the surface of a substrate covered with a resin and subsequently applying a coating liquid onto the surface of the substrate in order to form an ink receiving layer on the substrate; or by pressing a roller having a specific degree of irregularities against the surface of the recording medium.

Components of the recording medium according to the embodiment are described below.

Substrate

The substrate may be composed of a base paper or may include a base paper and a resin layer. That is, a base paper coated with a resin and a resin film may be used as a substrate. In this embodiment, it is advantageous that the substrate include a base paper and a resin layer disposed on the base paper. In such a case, the resin layer may be disposed on only one side of the base paper. Forming the resin layer on both sides of the base paper may reduce curling of the recording medium.

In this embodiment, the an average surface roughness Ra of the substrate specified in JIS B 0601:2001 is preferably 1.0 μm or more and 5.0 μm or less. Setting the arithmetic average surface roughness Ra of the substrate to be within the above range may increase the adhesion of the substrate to the ink receiving layer and further enhance the fold crack resistance of the recording medium.

In this embodiment, the thickness of the substrate is preferably 25 μm or more and 500 μm or less and is more preferably 50 μm or more and 300 μm or less. Setting the thickness of the substrate to 25 μm or more may increase the stiffness of the recording medium and enhance the feeling and quality of the recording medium which are perceived when the recording medium is touched by hand. Setting the thickness of the substrate to 500 μm or less may achieve a smooth paper feeding in a printer. The basis weight of the substrate is preferably 25 $g/m^2$ or more and 500 $g/m^2$ or less.

Base Paper

The base paper is mainly made of a wood pulp and may optionally contain a synthetic pulp such as polypropylene, or a synthetic fiber such as nylon or polyester. Examples of wood pulps include leaf bleached kraft pulp (LBKP), leaf bleached sulfite pulp (LBSP), needle bleached kraft pulp (NBKP), needle bleached sulfide pulp (NBSP), leaf dissolving pulp (LDP), needle dissolving pulp (NDP), leaf unbleached kraft pulp (LUKP), and needle unbleached kraft pulp (NUKP). The above wood pulps may be used alone or in combination of two or more. Among the above wood pulps, LBKP, NBSP, LBSP, NDP, and LDP, which contain a large amount of short fiber components, may be advantageously used. Chemical pulps that do not contain a large amount of impurities, such as a sulfate pulp and a sulfite pulp, may also be used. Pulps that have been bleached in order to increase the brightness may also be used. The base paper may further contain a sizing agent, a white pigment, a reinforcing agent, a fluorescent brightening agent, a moisturizing agent, a dispersant, or a softening agent, as needed.

Resin Layer

In this embodiment, in the case where the base paper is coated with a resin, the resin layer may be disposed on the base paper so as to cover at least a part of the surface of the base paper. The coverage of the resin layer (i.e., [area of the surface of the base paper which is covered with the resin layer]/[area of the entire surface of the base paper]) is preferably 70% or more, is more preferably 90% or more, and is particularly preferably 100%. In other words, the entire surface of the base paper is particularly preferably covered with the resin layer.

In this embodiment, the thickness of the resin layer is preferably 20 μm or more and 60 μm or less and is more preferably 35 μm or more and 50 μm or less. In the case where the resin layer is disposed on both surfaces of the base paper, it is advantageous that the thicknesses of the resin layers disposed on the respective surfaces of the base paper each fall within the above range.

The resin layer may be composed of a thermoplastic resin. Examples of the thermoplastic resin include an acrylic resin, an acrylic silicone resin, a polyolefin resin, and a styrene-butadiene copolymer. Among the above thermoplastic resins, a polyolefin resin may be advantageously used. Note that the term "polyolefin resin" used herein refers to a polymer produced using an olefin as a monomer. Specific examples of the polyolefin resin include homopolymers and copolymers including one or more monomers such as ethylene, propylene, and isobutylene. One or more polyolefin resins may be used as needed. Among the above polyolefin resins, polyethylene may be advantageously used. The polyethylene may be low-density polyethylene (LDPE) or high-density polyethylene (HDPE).

In this embodiment, a white pigment, a fluorescent brightening agent, ultramarine blue, and the like may be added to the resin layer in order to control the opacity, brightness, and hue of the recording medium. In particular, a white pigment may enhance the opacity of the recording medium. Examples of the white pigment include rutile-type titanium oxide and anatase-type titanium oxide. In this embodiment, the content of the white pigment in the resin layer is preferably 3 $g/m^2$ or more and 30 $g/m^2$ or less. In the case where the resin layer is disposed on both sides of the base paper, it is advantageous that the total content of the white pigment in the two resin layers fall within the above range. The content of the white pigment in the resin layer is preferably 25% by mass or less of the resin content in the resin layer from the viewpoint of the dispersion stability of the white pigment.

Ink Receiving Layer

In a first embodiment of the present disclosure, the ink receiving layer includes, as inorganic particles, at least one type of alumina particles selected from fumed alumina particles and hydrated alumina particles and a resin having a glass transition temperature of 20° C. or less which serves as a binder (hereinafter, this ink receiving layer is referred to as "first ink receiving layer"). In this embodiment, the thickness of the first ink receiving layer is preferably 20 μm or more and 35 μm or less and is more preferably 20 μm or more and 30 μm or less. In the case where a second ink receiving layer is disposed on the ink receiving layer on a side opposite to the side on which the substrate is disposed, the thickness of the second ink receiving layer is preferably 1 μm or more and 9 μm or less.

In a second embodiment of the present disclosure, the ink receiving layer includes alumina particles that serve as inorganic particles and, as binders, a water-soluble resin (1) and a resin (2) having an average particle diameter of 0.3 μm or more and an elongation of 550% or more.

The ink receiving layer may have a multilayer structure constituted by an ink receiving layer (A) and an ink receiving layer (B) disposed on the ink receiving layer (A) in order to improve the color developability and ink absorbency of the recording medium. It is advantageous that the ink receiving layer (B) include the inorganic particles and the water-soluble resin (1) but do not include the resin (2) having an average particle diameter of 0.3 μm or more and an elongation of 550% or more. Regardless of whether the ink receiving layer (B) includes the resin (2), it is advantageous that the total amount of the resins (1) and (2) included in the ink receiving layer (B) relative to 100 parts by mass of the inorganic particles included in the ink receiving layer (B) be lower than the total content of the resins (1) and (2) in the ink receiving layer (A) relative to 100 parts by mass of the alumina particles included in the ink receiving layer (A).

The thickness of the ink receiving layer (B) is preferably 1 μm or more and 10 μm or less.

Setting the thickness of the ink receiving layer (B) to be within the above range may enhance the ink absorbency of the recording medium and image density and diminish the appearance of fold cracking.

The term "thickness" of a layer used herein refers to that measured when the layer is completely dried. In this embodiment, the thickness of a layer is determined by measuring the thickness of the layer at four positions in a cross section of the layer which is observed with a scanning electron microscope (SEM) and taking the average thereof.

Materials that may be added to the ink receiving layer are described below.

Inorganic Particles

In this embodiment, the first ink receiving layer includes, as inorganic particles, at least one type of alumina particles selected from fumed alumina particles and hydrated alumina particles. Whether the first ink receiving layer includes the alumina particles may be confirmed by conducting an elementary analysis such as X-ray photoelectron spectroscopy (XPS) or energy dispersive X-ray spectrometry (EDX). The first ink receiving layer may also include inorganic particles other than the alumina particles. The second ink receiving layer may include inorganic particles.

Examples of inorganic particles other than hydrated alumina particles or fumed alumina particles include particles of silica (e.g., fumed silica and wet-process silica), colloidal silica, titanium dioxide, zeolite, kaolin, talc, hydrotalcite, zinc oxide, zinc hydroxide, aluminium silicate, calcium silicate, magnesium silicate, zirconium oxide, and zirconium hydroxide. The above inorganic particles may be used alone or in combination of two or more. Among the above inorganic particles, in particular, particles of hydrated alumina, fumed alumina, and fumed silica enable an ink receiving layer having a porous structure which has high ink absorbency to be formed.

In this embodiment, the inorganic particles may be added to a coating liquid used for forming the ink receiving layer (hereinafter, referred to as "ink-receiving-layer forming coating liquid") in the form of a dispersion prepared using a dispersant. The average secondary particle size of the inorganic particles in the dispersion is preferably 0.1 nm or more and 500 nm or less, is more preferably 1.0 nm or more and 300 nm or less, and is particularly preferably 10 nm or more and 250 nm or less. The average secondary particle size of the inorganic particles in the dispersion may be measured by dynamic light scattering.

(1) Hydrated Alumina

Hydrated alumina represented by General Formula (X) below may be added to the ink receiving layer.

$$Al_2O_{3-n}(OH)_{2n}.mH_2O \qquad \text{General Formula (X):}$$

where n is 0, 1, 2, or 3; m is a number of 0 or more and 10 or less and is preferably a number of 0 or more and 5 or less; and m and n are not set to 0 simultaneously.

In General Formula (X), since $mH_2O$ represents a desorbable aqueous phase that is commonly not involved in the formation of crystal lattices, m is not necessarily an integer; and m can be brought to 0 by heating hydrated alumina.

In this embodiment, the hydrated alumina may be produced in a known process. Specifically, the hydrated alumina may be produced by, for example, hydrolysis of aluminium alkoxide, by hydrolysis of sodium aluminate, or by adding an aqueous solution of aluminium sulfate or aluminium chloride to an aqueous sodium aluminate solution in order to perform neutralization.

The hydrated alumina may be amorphous or may have a crystal structure in the form of gibbsite or boehmite depending on the temperature of heat treatment. The crystal structure of the hydrated alumina may be analyzed by X-ray diffraction. In this embodiment, it is advantageous that the hydrated alumina be amorphous or have a crystal structure in the form of boehmite. Specific examples of the hydrated alumina include hydrated alumina disclosed in Japanese Patent Laid-Open Nos. 7-232473, 8-132731, 9-66664, and 9-76628 and commercially available hydrated alumina such as "Disperal HP 14 and HP 18" produced by Sasol Limited. These types of hydrated alumina may be used alone or in combination of two or more.

In this embodiment, the number-average diameter of the primary particles of the hydrated alumina is preferably 5 nm or more and 50 nm or less. The hydrated alumina particles preferably have a tabular shape having an aspect ratio of 2 or more. In this embodiment, the aspect ratio of the hydrated alumina particles may be determined by the method described in Japanese Patent Publication No 5-16015. Specifically, the aspect ratio of the hydrated alumina particles refers to the ratio of the diameter of the particles to the thickness of the particles, where the term "diameter" refers to equivalent circle diameter, which is the diameter of a circle having an area equal to the projected area of the hydrated alumina particles which is observed with an electron microscope.

In this embodiment, the specific surface area of the hydrated alumina particles determined by a BET method is preferably 100 $m^2/g$ or more and 200 $m^2/g$ or less and is more preferably 125 $m^2/g$ or more and 175 $m^2/g$ or less. In a BET method, molecules or ions having a known size are adsorbed onto the surfaces of sample particles, and the specific surface area of the sample particles is calculated from the amount of molecules or ions adsorbed. In this embodiment, nitrogen gas is adsorbed to the sample particles.

(2) Fumed Alumina

Examples of fumed alumina that may be added to the ink receiving layer include γ-alumina, α-alumina, δ-alumina, θ-alumina, and χ-alumina. Among the above types of alumina, γ-alumina may be advantageously used from the viewpoints of the optical density of images and the ink absorbency of the recording medium. Specific examples of the fumed alumina include AEROXIDE Alu C, Alu130, and Alu65 produced by Evonik Industries.

In this embodiment, the specific surface area of the fumed alumina particles determined by a BET method is preferably 50 $m^2/g$ or more and 150 $m^2/g$ or less and is more preferably 80 $m^2/g$ or more and 120 $m^2/g$ or less.

The average primary particle size of the fumed alumina is preferably 5 nm or more and 30 nm or less and is more preferably 11 nm or more and 15 nm or less.

In this embodiment, the hydrated alumina or the fumed alumina may be added to the ink-receiving-layer forming coating liquid in the form of an aqueous dispersion. For forming the aqueous dispersion, an acid may be used as a dispersant. Using the sulfonic acid represented by General Formula (Y) below may reduce the bleeding of images.

$$R—SO_3H \qquad \text{General Formula (Y):}$$

where R represents a hydrogen atom, an alkyl group having 1 to 4 carbon atoms, or an alkenyl group having 1 to 4 carbon atoms; and the group represented by R may include a substituent selected from an oxo group, a halogen atom, an alkoxy group, and an acyl group.

In this embodiment, the content of the above-described acid is preferably 1.0% by mass or more and 2.0% by mass or less and is more preferably 1.3% by mass or more and 1.6% by mass or less of the total content of the hydrated alumina and the fumed alumina.

(3) Silica

Silica that may be included in the ink receiving layer is roughly classified according to the production method into two groups: silica produced by a wet process (hereinafter, referred to as "wet-process silica") and silica produced by a dry process (i.e., gas-phase process) (hereinafter, referred to as "fumed silica"). In a known wet process, acid decomposition of silicate is performed in order to produce active silica, the active silica is polymerized to a certain degree, and the polymerized active silica is flocculated and precipitated in order to produce hydrous silica. In a known dry process (i.e., gas-phase process), anhydrous silica is produced by hydrolysis (i.e., flame hydrolysis) of silicon halide in a high-temperature gas phase or by performing reduction vaporization of silica sand and coke in an electric furnace by heating using arc discharge and oxidizing the vapor in the air (i.e., arc process). In this embodiment, silica produced by a dry process (i.e., gas-phase process), that is, "fumed silica", may be used. This is because fumed silica particles have a particularly large specific surface area and therefore have markedly high ink absorbency. Furthermore, because fumed silica has a low refractive index, the transparency of the ink receiving layer may be enhanced, which enables good color developability to be achieved. Specific examples of the fumed silica include AEROSIL produced by Nippon Aerosil Co., Ltd. and REOLOSIL QS produced by Tokuyama Corporation.

In this embodiment, the specific surface area of the fumed silica particles determined by a BET method is preferably 50 $m^2/g$ or more and 400 $m^2/g$ or less and is more preferably 200 $m^2/g$ or more and 350 $m^2/g$ or less.

In this embodiment, the fumed silica particles may be added to the ink-receiving-layer forming coating liquid in the form of a dispersion prepared with a dispersant. The size of the fumed silica particles in the dispersion is preferably 50 nm or more and 300 nm or less. The size of the fumed silica particles in the dispersion may be measured by dynamic light scattering. Examples of the dispersant used for dispersing the fumed silica particles include cationic resins and salts of polyvalent metals. Examples of the cationic resins include polyethyleneimine resins, polyamine resins, polyamide resins, polyamide-epichlorohydrin resins, polyamine-epichlorohydrin resins, polyamide-polyamine-epichlorohydrin resins, polydiallylamine resins, and condensates of dicyandiamide. Examples of the salts of polyvalent metals include aluminium compounds such as polyaluminium chloride, polyaluminium acetate, and polyaluminium lactate.

Binder

In the first embodiment of the present disclosure, the first ink receiving layer includes a resin having a glass transition temperature of 20° C. or less in addition to the at least one type of alumina particles selected from fumed alumina particles and hydrated alumina particles used as inorganic particles. The first ink receiving layer may further include binders other than the resin having a glass transition temperature of 20° C. or less. The second ink receiving layer may include a binder. The content of the resin having a glass transition temperature of 20° C. or less in the second ink receiving layer is preferably 5% by mass or less and is more preferably 1% by mass or less of the content of the inorganic particles included in the second ink receiving layer. Particularly preferably, the second ink receiving layer does not include the resin having a glass transition temperature of 20° C. or less.

As described above, in this embodiment, the content of the binder in the first ink receiving layer (i.e., the total content of the resin having a glass transition temperature of 20° C. or less and other binders) is 25% by mass or more, is more preferably 25% by mass or more and 70% by mass or less, and is further preferably 25% by mass or more and 50% by mass or less of the content of the inorganic particles included in the first ink receiving layer.

(1) Resin Having Glass Transition Temperature of 20° C. or Less

In the first embodiment of the present disclosure, the resin having a glass transition temperature of 20° C. or less may be added to an ink-receiving-layer forming coating liquid in the form of resin particles dispersed in water. Examples of such a resin include a polyester resin; conjugated diene polymers such as a styrene-butadiene copolymer, an acrylonitrile-butadiene copolymer, and a methyl(meth)acrylate-butadiene copolymer; acrylic resins such as polymers and copolymers of a (meth)acrylic acid ester; vinyl polymers such as a vinyl acetate-maleic acid ester copolymer, a vinyl acetate-ethylene copolymer, a vinyl acetate-acryl copolymer, a vinyl acetate-ethylene-acryl copolymer, and a vinyl acetate-vinyl chloride copolymer; functional-group-containing modified polymers produced by modifying the above resins with a carboxyl group, a cationic group, or the like; thermosetting resins such as a melamine resin and a urea resin; and synthetic resin adhesives such as maleic anhydride copolymers, polyacrylamides, polymethyl methacrylates, polyurethane resins, unsaturated polyester resins, polyvinyl butyral, and alkyd resins. In particular, it is advantageous that the resin having a glass transition temperature of 20° C. or less include a unit derived from vinyl acetate and a unit derived from ethylene, that is, that the resin having a glass transition temperature of 20° C. or less be a copolymer of vinyl acetate and ethylene.

In this embodiment, the resin having a glass transition temperature of 20° C. or less may be a nonionic resin or a cationic resin.

The content of the resin having a glass transition temperature of 20° C. or less in the first ink receiving layer is preferably 15% by mass or more and 60% by mass or less and is more preferably 20% by mass or more and 40% by mass or less of the content of the inorganic particles included in the first ink receiving layer.

(2) Other Binders

Examples of the other binders that may be used in the first embodiment of the present disclosure include starch derivatives such as oxidized starch, etherified starch, and phosphorylated starch; cellulose derivatives such as carboxymethyl cellulose and hydroxyethyl cellulose; and casein, gelatin, soy protein, polyvinyl alcohol, polyvinylpyrrolidone, polyacrylic acid, polyacrylamide, polyvinylacetamide, and derivatives thereof. These binders may be used alone or in combination of two or more.

Among the above binders, in particular, polyvinyl alcohol may be advantageously used. Note that the term "polyvinyl alcohol" used herein refers to polyvinyl alcohol and derivatives of polyvinyl alcohol. Examples of the derivatives of polyvinyl alcohol include cation-modified polyvinyl alcohol, anion-modified polyvinyl alcohol, silanol-modified polyvinyl alcohol, and polyvinyl acetal. An example of the cation-modified polyvinyl alcohol is polyvinyl alcohol having a backbone chain or a side chain including a primary, secondary, or tertiary amino group or a quaternary ammonium group as described in Japanese Patent Laid-Open No. 61-10483.

Polyvinyl alcohol may be synthesized by, for example, saponification of polyvinyl acetate. The degree of saponification of the polyvinyl alcohol is preferably 80 mol % or more and 100 mol % or less and is more preferably 85 mol % or more and 98 mol % or less. The degree of saponification is the proportion of the number of moles of hydroxyl groups created by saponification of polyvinyl acetate by which the polyvinyl alcohol is synthesized. In this embodiment, the degree of saponification is determined in accordance with JIS-K6726. The average degree of polymerization of the polyvinyl alcohol is preferably 2,500 or more and is more preferably 3,000 or more and 5,000 or less. In this embodiment, the average degree of polymerization is the viscosity-average degree of polymerization determined in accordance with JIS-K6726.

The glass transition temperature of the polyvinyl alcohol is preferably 40° C. or more and is more preferably 70° C. or more. The glass transition temperature of the polyvinyl alcohol is preferably 90° C. or less. In this embodiment, the glass transition temperature may be determined by differential scanning calorimetry (DSC).

The polyvinyl alcohol may be added to an ink-receiving-layer forming coating liquid in the form of an aqueous solution. In such a case, the solid content of the polyvinyl alcohol in the aqueous solution is preferably 3% by mass or more and 20% by mass or less.

In this embodiment, the content of the polyvinyl alcohol in the first ink receiving layer is 5% by mass or more and 45% by mass or less and is more preferably 10% by mass or more and 45% by mass or less of the content of the inorganic particles included in the first ink receiving layer.

In this embodiment, the content of the polyvinyl alcohol in the second ink receiving layer is preferably 5% by mass or more and 30% by mass or less and is more preferably 10% by mass or more and 25% by mass or less of the content of the inorganic particles included in the second ink receiving layer.

Resin (1)

In the second embodiment of the present disclosure, the ink receiving layers (A) and (B) include a resin (1). In this embodiment, the resin (1) serves as a resin capable of binding inorganic particles and forming a coating film.

In this embodiment, the amount of the resin (1) included in the ink receiving layer (A) is preferably 35 parts by mass or less and is more preferably 30 parts by mass or less relative to 100 parts by mass of the content of the alumina from the viewpoint of the ink absorbency of the recording medium. In this embodiment, the amount of the resin (1) included in the ink receiving layer (A) is preferably 5 parts by mass or more and is more preferably 10 parts by mass or more relative to 100 parts by mass of the content of the alumina from the viewpoint of the fold crack resistance of the recording medium.

The amount of the resin (1) included in the ink receiving layer (B) is preferably 30 parts by mass or less and is more preferably 25 parts by mass or less relative to 100 parts by mass of the content of the alumina particles included in the ink receiving layer (B) from the viewpoint of the ink absorbency of the recording medium. The amount of the resin (1) included in the ink receiving layer (B) is preferably 5 parts by mass or more and is more preferably 10 parts by mass or more relative to 100 parts by mass of the content of the alumina particles included in the ink receiving layer (B) from the viewpoint of the fold crack resistance of the recording medium.

Examples of the resin (1) that may be used in this embodiment include starch derivatives such as oxidized starch, etherified starch, and phosphorylated starch; cellulose derivatives such as carboxymethyl cellulose and hydroxyethyl cellulose; and casein, gelatin, soy protein, polyvinyl alcohol, polyvinylpyrrolidone, polyacrylic acid, polyacrylamide, polyvinylacetamide, and derivatives thereof. The above resins may be used alone or in combination of two or more.

Among the above resins, polyvinyl alcohol and derivatives of polyvinyl alcohol may be advantageously used in order to prevent cracking that may occur when the coating film is dried and enhance the water resistance of the coating film. Examples of the derivatives of polyvinyl alcohol include cation-modified polyvinyl alcohol, anion-modified polyvinyl alcohol, silanol-modified polyvinyl alcohol, and polyvinyl acetal. An example of the cation-modified polyvinyl alcohol is polyvinyl alcohol having a backbone chain or a side chain including a primary, secondary, or tertiary amino group or a quaternary ammonium group as described in Japanese Patent Laid-Open No. 61-10483.

The polyvinyl alcohol may be synthesized by, for example, saponification of polyvinyl acetate. The degree of saponification of the polyvinyl alcohol is preferably 80 mol % or more and 100 mol % or less and is more preferably 85 mol % or more and 98 mol % or less. The degree of saponification is the proportion of the number of moles of hydroxyl groups created by saponification of polyvinyl acetate by which the polyvinyl alcohol is synthesized. In this embodiment, the degree of saponification is determined in accordance with JIS-K6726.

The average degree of polymerization of the polyvinyl alcohol or derivatives of polyvinyl alcohol is preferably 2,500 or more and is more preferably 3,000 or more and 5,000 or less. In this embodiment, the average degree of polymerization is the viscosity-average degree of polymerization determined in accordance with JIS-K6726.

The glass transition temperature Tg of the polyvinyl alcohol is 40° C. or more. The glass transition temperature Tg of the polyvinyl alcohol having a more preferable degree of saponification and a more preferable degree of polymerization described above may be 70° C. or more and 90° C. or less.

The polyvinyl alcohol and the derivatives of polyvinyl alcohol may be added to an ink-receiving-layer forming coating liquid in the form of an aqueous solution. In such a case, the solid content of the polyvinyl alcohol or the derivatives of polyvinyl alcohol included in the aqueous solution is preferably 3% by mass or more and 20% by mass or less.

Resin (2)

In the second embodiment of the present disclosure, among sublayers of the ink receiving layer, at least the ink receiving layer (A), which is adjacent to the substrate, includes a resin (2) having an average particle diameter of 0.3 μm or more and an elongation of 550% or more. Setting the average particle diameter of the resin (2) to 0.3 μm or more and the elongation of the resin (2) to 550% or more may enhance the flexibility of the ink receiving layer and reduce cracking in the ink receiving layer which may occur when the recording medium is folded in half and subsequently opened and closed repeatedly. The electric charge of the surface of the resin (2) used in this embodiment may be cationic or nonionic from the viewpoint of the color developability of an ink.

The resin (2) may be added to the ink-receiving-layer forming coating liquid in the form of an aqueous emulsion from the viewpoint of miscibility with the coating liquid that is an aqueous solution.

The average particle diameter of the resin (2) is that measured when the resin (2) is in the form of an aqueous emulsion by dynamic light scattering. The elongation of the resin (2) is the elongation of the resin (2) at break which is determined in accordance with JIS K6251-2010. The elongation of the resin (2) is measured using a dumbbell-shaped test specimen No. 3 having a thickness of 2.0 mm at a tensile speed of 500 mm/min.

In this embodiment, it is more advantageous that the resin (2) included in the ink receiving layer be present inhomogeneously inside the ink receiving layer in the form of resin blocks than that the resin (2) be present homogeneously inside the ink receiving layer. Distributing the resin (2) inhomogeneously inside the ink receiving layer enables the mechanical properties of the resin (2) to be exhibited in the ink receiving layer. Specifically, when the ink receiving layer is compressed and deformed in the production of a photo book, the blocks of the resin (2) are selectively compressed and deformed. This may reduce the compression of the entire ink receiving layer and cracking in the ink receiving layer (hereinafter, this effect is referred to as "compression reduction effect"). If the resin (2) is present homogeneously inside the ink receiving layer, the compression reduction effect may fail to be achieved when the ink receiving layer is compressed and deformed in the production of a photo book and, as a result, the fold crack resistance of the recording medium may be degraded. Selecting the optimum particle diameter and the optimum elongation of the resin (2) enables the compression reduction effect to be maintained even when the photo book is repeatedly opened and closed. That is, a recording medium having high durability to maintain the fold crack resistance may be produced.

The distribution of the resin (2) inside the ink receiving layer may be confirmed by observing a cross-section sample of the ink receiving layer, which may prepared with a microtome or the like, with a SEM or the like. When the cross-section sample is prepared, a freezing method in which a cryomicrotome or the like is used may be advantageously used in order to minimize the deformation of the resin and the like. The average particle diameter of the resin (2) which can be measured by observing the cross-sectional sample is substantially equal to that measured by dynamic light scattering described above.

For distributing the resin (2) inside the ink receiving layer in the above-described manner, a water-soluble resin may be used as a resin (1), and a resin emulsion may be used as a resin (2). This is because, when a coating film composed of the ink-receiving-layer forming coating liquid is dried in the preparation of the ink receiving layer, phase separation may occur due to low miscibility between a water-soluble resin and a resin emulsion. Due to the above-described effect, the resin emulsion may be distributed inside the ink receiving layer inhomogeneously even when the drying temperature is equal to or more than the minimum film-forming temperature of the resin emulsion. Using a solid resin, such as resin particles, as a resin (2) also enables the resin (2) to be distributed in the above-described manner. It is advantageous to use a resin emulsion as a resin (2) from the viewpoints of the selectivity and physical properties of the resin (2) and economy.

The size of the blocks of the resin (2) in the ink receiving layer is preferably 0.3 μm or more. If the size of the resin blocks is excessively small, the above-described compression reduction effect may be reduced. The size of the resin blocks is substantially equal to the diameter of the particles of the resin emulsion dispersed inside the ink-receiving-layer forming coating liquid. Therefore, the average particle diameter of the resin (2) is set to 0.3 μm or more. The elongation of the resin (2) at break is set to 550% or more in order to achieve the compression reduction effect of the resin blocks inside the ink receiving layer in an efficient manner.

Examples of the resin (2) having an average particle diameter of 0.3 μm or more and an elongation of 550% or more which may be used in this embodiment include a polyester resin; conjugated diene polymers such as a styrene-butadiene copolymer, an acrylonitrile-butadiene copolymer, and a methyl(meth)acrylate-butadiene copolymer; acrylic polymers such as polymers and copolymers of acrylic acid esters and methacrylic acid esters; vinyl polymers such as a vinyl acetate-maleic acid ester copolymer, a vinyl acetate-ethylene copolymer, a vinyl acetate-acrylic copolymer, a vinyl acetate-ethylene-acrylic copolymer, and a vinyl acetate-vinyl chloride copolymer; functional-group-containing modified polymers produced by modifying the above polymers with a carboxyl group, a cationic croup, or the like; aqueous synthetic resin adhesives including thermosetting resins such as a melamine resin and a urea resin; and synthetic resin adhesives such as maleic anhydride copolymers, polyacrylamides, polymethyl methacrylates, polyurethane resins, unsaturated polyester resins, polyvinyl butyral, and alkyd resins. Among the above resins, a polyurethane resin may be advantageously used from the viewpoint of the durability to maintain the fold crack resistance.

In this embodiment, the amount of the resin (2) included in the ink receiving layer (A) is preferably 50 parts by mass or less and is more preferably 40 parts by mass or less relative to 100 parts by mass of the content of the alumina included in the ink receiving layer (A) from the viewpoint of the ink absorbency of the recording medium, and the amount of the resin (2) included in the ink receiving layer (A) is preferably 15 parts by mass or more and is more preferably 20 parts by mass or more relative to 100 parts by mass of the content of the alumina included in the ink receiving layer (A) from the viewpoint of the fold crack resistance of the recording medium.

In this embodiment, the total amount of the resins (1) and (2) included in the ink receiving layer (A) is preferably 50 parts by mass or less and is more preferably 45 parts by mass or less relative to 100 parts by mass of the content of the alumina included in the ink receiving layer (A) from the viewpoint of the ink absorbency of the recording medium, and the total amount of the resins (1) and (2) included in the ink receiving layer (A) is preferably 20 parts by mass or more and is more preferably 25 parts by mass or more relative to 100 parts by mass of the content of the alumina included in the ink receiving layer (A) from the viewpoint of the fold crack resistance of the recording medium.

Crosslinking Agent

In the first embodiment, the ink receiving layer may further include a crosslinking agent. Examples of the crosslinking agent include aldehyde compounds, melamine compounds, isocyanate compounds, zirconium compounds, amide compounds, aluminium compounds, boric acids, and salts of boric acids. The above crosslinking agents may be used alone or in combination of two or more. In particular, among the above crosslinking agents, boric acids and salts of boric acids may be advantageously used when polyvinyl alcohol or a derivative of polyvinyl alcohol is used as a binder.

Examples of the boric acids include orthoboric acid ($H_3BO_3$), metaboric acid, and diboric acid. Water-soluble salts of the above boric acids may be advantageously used. Examples of such boric acid salts include alkali-metal salts of boric acids, such as sodium salts of boric acids and potassium salts of boric acids; alkaline-metal salts of boric acids, such as magnesium salts of boric acids and calcium salts of boric acids; and ammonium salts of boric acids. Among the above boric acids, orthoboric acid may be advantageously used in order to enhance the temporal stability of the coating liquid and reduce the occurrence of cracking.

The amount of crosslinking agent used may be controlled appropriately depending on the production conditions and the like. In the first embodiment, the content of the crosslinking agent in the ink receiving layer is preferably 1.0% by mass or more and 50% by mass or less and is more preferably 5% by mass or more and 40% by mass or less of the content of the binder included in the ink receiving layer.

In the case where polyvinyl alcohol is used as a binder and at least one crosslinking agent selected from boric acids and salts of the boric acids is used, the total content of the crosslinking agents selected from boric acids and salts of the boric acids in the ink receiving layer is preferably 5% by mass or more and 30% by mass or less of the content of the polyvinyl alcohol included in the ink receiving layer.

Other Additives

In this embodiment, the ink receiving layer may further include additives other than those described above. Specific examples of the other additives include a pH adjuster, thickener, a fluidity improving agent, an antifoaming agent, a foam suppressor, a surfactant, a release agent, a penetrant, a coloring pigment, a coloring dye, a fluorescent brightening agent, an ultraviolet absorbing agent, an antioxidant, a preservative, a fungicide, a water resistant additive, a dye fixing agent, a curing agent, and a weather-resistant material.

Undercoat Layer

The recording medium according to the embodiment may optionally include an undercoat layer interposed between the substrate and the ink receiving layer in order to increase the adhesion between the substrate and the ink receiving layer. The undercoat layer may include a water-soluble polyester resin, gelatin, polyvinyl alcohol, and the like. The thickness of the undercoat layer is preferably 0.01 μm or more and 5 μm or less.

Backcoat Layer

The recording medium according to the embodiment may optionally include a backcoat layer disposed on the substrate on a side opposite to the side on which the ink receiving layer is disposed in order to increase the ease of handling and ease of conveyance of the recording medium and enhance the resistance of the recording media to rubbing against one another when a number of recording media are conveyed in continuous printing. The backcoat layer may include a white pigment, a binder, and the like. The thickness of the backcoat layer is preferably controlled such that a dry coating amount of 1 $g/m^2$ or more and 25 $g/m^2$ or less is achieved.

Topcoat Layer

The recording medium according to the embodiment may optionally include a topcoat layer mainly composed of colloidal silica which is disposed on the topmost surface thereof in order to enhance the scratch resistance of the recording medium. The average primary particle size of the colloidal silica is preferably 20 μm or more and 200 μm or less. The dry coating amount of the topcoat layer is preferably 0.01 $g/m^2$ or more and 2 $g/m^2$ or less.

Method for Producing Recording Medium

A method for producing the recording medium according to the embodiment is not limited and may include a step of preparing an ink-receiving-layer forming coating liquid and a step of applying the ink-receiving-layer forming coating liquid to a substrate. The method for producing the recording medium is described below.

Preparation of Substrate

In this embodiment, the base paper of the substrate may be prepared by a common paper making process. Examples of paper making machines include a Fourdrinier machine, a cylinder machine, a drum machine, and a twin wire machine. The base paper may be subjected to a surface treatment in order to enhance the flatness and smoothness of the surface by applying heat and pressure during or after paper making. Specific examples of the surface treatment include calendering such as machine calendering and super calendering.

For forming a resin layer over the base paper, that is, for covering the base paper with a resin, for example, melt extrusion, wet lamination, or dry lamination may be performed. Melt extrusion, in which the base paper is coated by extruding a molten resin onto either or both sides of the base paper, may be advantageously employed. For example, a method called extrusion coating is widely used in which a transported base paper and a resin sheet extruded from an extrusion die are brought into contact with each other at a nip point between a nip roller and a cooling roller and pressed with the nip so that the base paper is coated with the resin sheet. In the case where a resin layer is formed by melt extrusion, a pretreatment may be performed in order to increase the adhesion between the base paper and the resin layer. Examples of the pretreatment include acid etching with a mixed solution of sulfuric acid and chromic acid, a gas flame treatment, UV exposure, corona discharge, glow discharge, and anchor coating with alkyl titanate or the like. Among the above pretreatment techniques, corona discharge may be advantageously used. To add a white pigment to the resin layer, a mixture of a resin and the white pigment may be applied to the base paper.

Formation of Ink Receiving Layer

The ink receiving layer may be formed on the substrate of the recording medium according to the embodiment, for example, in the following manner. The ink-receiving-layer forming coating liquid is prepared. The coating liquid is applied to the substrate and is subsequently dried to form the recording medium according to the embodiment. For applying the coating liquid to the substrate, curtain coating, extrusion coating, slide hopper coating, and the like may be employed. The coating liquid may be heated when being applied to the substrate. For drying the coating layer, a hot air dryer may be used, such as a linear tunnel dryer, an arch dryer, an air loop dryer, or a sine curve air flow dryer, or any other dryer may be used, such as IR dryer, heating dryer, or microwave dryer.

EXAMPLES

The present disclosure will be further described in detail with reference to Examples and Comparative Examples. However, the disclosure is not limited to the following Examples within the scope and spirit of the disclosure. In the following Examples, "part (s)" are on a mass basis unless otherwise specified.

Preparation of Recording Media

Preparation of Substrates

To a slurry of 100 parts of leaf bleached kraft pulp, 20 parts of precipitated calcium carbonate was added. To the resulting mixture, 2 parts of cationic starch and 0.3 parts of an alkenyl-succinic-anhydride neutral sizing agent were added. The mixture was stirred sufficiently to prepare a paper stock. The paper stock was subjected to a Fourdrinier machine and dried until the moisture content in the resulting paper sheet reached 10%. A 7%-oxidized starch solution was applied to both surfaces of the paper sheet with a size press machine such that the amount of oxidized starch solution deposited was 4 g/m$^2$. The paper sheet was dried until the moisture content reached 7%. Thus, a base paper having a basis weight of 110 g/m$^2$ was prepared. Subsequently, a resin composition including 20 parts of high-density polyethylene and 70 parts of low-density polyethylene was applied onto both surfaces of the base paper by melt extrusion such that the amount of coating was 30 g/m$^2$ per side. Immediately after the melt extrusion of the resin composition, irregularities were formed in the polyethylene surface layer by using a cooling roller having surface irregularities while the base paper was cooled. Thus, a substrate having a basis weight of 170 g/m$^2$ was prepared. Substrates A to G each having a different arithmetic average surface roughness Ra were prepared by changing, when irregularities are formed in the surface of each substrate, the pressure at which the cooling roller was pressed against the substrate and the height of the irregularities of the cooling roller used. The arithmetic average surface roughness Ra of the substrate was determined in accordance with JIS B 0601:2001 by using "Surfcorder SE3500" produced by Kosaka Laboratory Ltd. Table 1 summarizes the arithmetic average surface roughness Ra of the substrates A to G.

Preparation of Hydrated Alumina Sol

Methanesulfonic acid (1.5 parts) used as a deflocculant acid was added to 333 parts of ion-exchange water to prepare an aqueous solution of methanesulfonic acid. While the aqueous solution of methanesulfonic acid was stirred at 3,000 rpm with a homomixer "T.K. Homomixer MARK II Model 2.5" produced by PRIMIX Corporation, 100 parts of hydrated alumina "DISPERAL HP14" produced by Sasol Limited (specific surface area: 190 m$^2$/g) was added gradually to the aqueous solution. Stirring was continued for 30 minutes after the addition of hydrated alumina was completed. Thus, a hydrated alumina sol having a solid density of 23.0% by mass was prepared.

Preparation of Fumed Silica Sol

A cationic polymer "SHALLOL DC902P" produced by DKS Co. Ltd. (4.0 parts) was added to 333 parts of ion-exchange water to prepare an aqueous solution of the cationic polymer. While the aqueous solution of the cationic polymer was stirred at 3,000 rpm with a homomixer "T.K. Homomixer MARK II Model 2.5" produced by PRIMIX Corporation, 100 parts of fumed silica "AEROSIL300" produced by Evonik Industries was added gradually to the aqueous solution. After the addition of fumed silica was completed, the aqueous solution was diluted with ion-exchange water and subsequently subjected to a high-pressure homogenizer "Nanomizer" produced by Yoshida Kikai Co., Ltd. twice. Thus, a fumed silica sol having a solid density of 20.0% by mass was prepared.

Preparation of Gel-Method (Wet-Process) Silica Sol

A cationic polymer "SHALLOL DC902P" produced by DKS Co. Ltd. (4.0 parts) was added to 333 parts of ion-exchange water to prepare an aqueous solution of the cationic polymer. While the aqueous solution of the cationic polymer was stirred at 3,000 rpm with a homomixer "T.K. Homomixer MARK II Model 2.5" produced by PRIMIX Corporation, 100 parts of gel-method silica "NIPGEL AZ-200" produced by Tosoh Silica Corporation was added gradually to the aqueous solution. After the addition of gel-method silica was completed, the aqueous solution was diluted with ion-exchange water. Thus, a gel-method silica sol having a solid density of 20.0% by mass was prepared.

Preparation of Aqueous Polyvinyl Alcohol Solution

To 1,150 parts of ion-exchange water, 100 parts of polyvinyl alcohol "PVA235" produced by Kuraray Co., Ltd (degree of saponification: 88%, average degree of polymerization: 3,500) was added under stirring. After the addition of polyvinyl alcohol was completed, the resulting mixture was heated at 90° C. in order to dissolve the polyvinyl alcohol. Thus, an aqueous polyvinyl alcohol solution having a solid density of 8.0% by mass was prepared.

Preparation of Aqueous Polyvinylacetamide Solution.

To 2,400 parts of ion-exchange water, 100 parts of polyvinylacetamide "GE191-000" produced by Showa Denko K.K. (average molecular weight: 40 million) was added under stirring. After the addition of polyvinylacetamide was completed, the resulting mixture was heated at 90° C. in order to dissolve the polyvinylacetamide. Thus, an aqueous polyvinylacetamide solution having a solid density of 4.0% by mass was prepared.

Preparation of Coating Liquid A1 Used for Forming Ink Receiving Layer (A)

The aqueous polyvinyl alcohol solution was mixed with the hydrated alumina sol prepared above such that the amount of polyvinyl alcohol was 15 parts in terms of solid content relative to 100 parts of hydrated alumina included in the hydrated alumina sol. To the resulting liquid mixture, an ethylene-vinyl acetate resin emulsion "Sumikaflex 410HQ" produced by Sumitomo Chemical Co., Ltd. (glass transition temperature: −18° C.) was added such that the amount of ethylene-vinyl acetate resin was 20 parts in terms of solid content relative to 100 parts of hydrated alumina included in the liquid mixture. To the liquid mixture, subsequently, an aqueous solution of orthoboric acid having a solid density of 5% by mass was further added such that the amount of orthoboric acid was 0.75 parts relative to 100 parts of hydrated alumina included in the liquid mixture in terms of solid content. Thus, a coating liquid A1 was prepared.

Preparation of Coating Liquid B1 Used for Forming Ink Receiving Layer (B)

The aqueous polyvinyl alcohol solution was mixed width the hydrated alumina sol prepared above such that the amount of polyvinyl alcohol was 9 parts in terms of solid content relative to 100 parts of hydrated alumina included in the hydrated alumina sol. To the resulting liquid mixture, an aqueous solution of orthoboric acid having a solid density of 5% by mass was added such that the amount of orthoboric acid was 1 part relative to 100 parts of hydrated alumina included in the liquid mixture in terms of solid content. Thus, a coating liquid B1 was prepared.

Preparation of Coating Liquid B2 Used for Forming Ink Receiving Layer (B)

The aqueous polyvinyl alcohol solution was mixed with the fumed silica sol prepared above such that the amount of polyvinyl alcohol was 23 parts in terms of solid content relative to 100 parts of fumed silica included in the fumed silica sol. To the resulting liquid mixture, an aqueous solution of orthoboric acid having a solid density of 5% by mass was added such that the amount of orthoboric acid was 3 parts relative to 100 parts of fumed silica included in the liquid mixture in terms of solid content. Thus, a coating liquid B2 was prepared.

Preparation of Recording Media

Example 1-1

A recording medium of Example 1-1 was prepared by applying the coating liquid A1 onto one surface of the substrate A such that the thickness of the resulting coating film was 25.0 μm after being dried and subsequently drying the coating film.

Example 1-2

A recording medium of Example 1-2 was prepared as in Example 1-1, except that the emulsion added to the coating liquid A1 was changed to "Sumikaflex 355HQ" produced by Sumitomo Chemical Co., Ltd. (glass transition temperature: 7° C., ethylene-vinyl acetate resin emulsion).

Example 1-3

A recording medium of Example 1-3 was prepared as in Example 1-1, except that the emulsion added to the coating liquid A1 was changed to "Sumikaflex 470HQ" produced by Sumitomo Chemical Co., Ltd. (glass transition temperature: 0° C., ethylene-vinyl acetate resin emulsion).

Example 1-4

A recording medium of Example 1-4 was prepared as in Example 1-1, except that the emulsion added to the coating liquid A1 was changed to "Sumikaflex 752" produced by Sumitomo Chemical Co., Ltd. (glass transition temperature: 15° C., ethylene-vinyl acetate emulsion).

Example 1-5

A recording medium of Example 1-5 was prepared as in Example 1-1, except that the emulsion added to the coating liquid A1 was changed to "Superflex E2000" produced by DKS Co. Ltd. (glass transition temperature: −40° C., urethane resin emulsion).

Example 1-6

A recording medium of Example 1-6 was prepared as in Example 1-1, except that the amount of coating liquid A1 deposited was changed such that the thickness of the resulting coating film was 17.0 μm after being dried.

Example 1-7

A recording medium of Example 1-7 was prepared as in Example 1-1, except that the amount of coating liquid A1 deposited was changed such that the thickness of the resulting coating film was 20.0 μm after being dried.

Example 1-8

A recording medium of Example 1-8 was prepared as in Example 1-1, except that the amount of coating liquid A1 deposited was changed such that the thickness of the resulting coating film was 35.0 μm after being dried.

Example 1-9

A recording medium of Example 1-9 was prepared as in Example 1-1, except that the amount of coating liquid A1 deposited was changed such that the thickness of the resulting coating film was 37.0 μm after being dried.

Example 1-10

A recording medium of Example 1-10 was prepared as in Example 1-1, except that the amounts of polyvinyl alcohol and an ethylene-vinyl acetate resin emulsion added to the coating liquid A1 in terms of solid content were changed to 8 parts and 17 parts, respectively.

Example 1-11

A recording medium of Example 1-11 was prepared as in Example 1-1, except that the amounts of polyvinyl alcohol and ethylene-vinyl acetate resin emulsion added to the coating liquid A1 in terms of sold content were changed to 5 parts and 25 parts, respectively.

Example 1-12

A recording medium of Example 1-12 was prepared as in Example 1-1, except that the amount of polyvinyl alcohol added to the coating liquid A1 in terms of solid content was changed to 45 parts.

Example 1-13

A recording medium of Example 1-13 was prepared as in Example 1-1, except that the amount of ethylene-vinyl acetate resin emulsion added to the coating liquid A1 in terms of solid content was changed to 15 parts.

Example 1-14

A recording medium of Example 1-14 was prepared as in Example 1-1, except that the amount of ethylene-vinyl acetate resin emulsion added to the coating liquid A1 in terms of solid content was changed to 60 parts.

Example 1-15

A recording medium of Example 1-15 was prepared as in Example 1-1, except that the substrate A was changed to the substrate B.

Example 1-16

A recording medium of Example 1-16 was prepared as in Example 1-1, except that the substrate A was changed to the substrate C.

Example 1-17

A recording medium of Example 1-17 was prepared as in Example 1-1, except that the substrate A was changed to the substrate D.

Example 1-18

A recording medium of Example 1-18 was prepared as in Example 1-1, except that the substrate A was changed to the substrate E.

Example 1-19

A recording medium of Example 1-19 was prepared as in Example 1-1, except that the substrate A was changed to the substrate F.

Example 1-20

A recording medium of Example 1-20 was prepared as in Example 1-1, except that the substrate A was changed to the substrate G.

Example 1-21

A recording medium of Example 1-21 was prepared as in Example 1-1, except that the polyvinyl alcohol added to the coating liquid A1 was changed to polyvinylacetamide "GE191-000" produced by Showa Denko K.K. (average molecular weight: 40 million).

Example 1-22

A recording medium of Example 1-22 was prepared as in Example 1-1, except that the polyvinyl alcohol added to the coating liquid A1 was changed to another polyvinyl alcohol "PVA224" produced by Kuraray Co., Ltd (degree of saponification: 88%, average degree of polymerization: 2,400).

Example 1-23

An ink receiving layer (A) was formed on the substrate A by applying the coating liquid A1 onto one surface of the substrate A such that the thickness of the resulting coating film was 25.0 μm after being dried and subsequently drying the coating film. An ink receiving layer (B) was formed on the ink receiving layer (A) by applying the coating liquid B1 to the ink receiving layer (A) such that the thickness of the resulting coating film was 5.0 μm after being dried and subsequently drying the coating film. Thus, a recording medium of Example 1-23 was prepared.

Example 1-24

An ink receiving layer (A) was formed on the substrate A by applying the coating liquid A1 onto one surface of the substrate A such that the thickness of the resulting coating film was 25.0 μm after being dried and subsequently drying the coating film. An ink receiving layer (B) was formed on the ink receiving layer (A) by applying the coating liquid B2 to the ink receiving layer (A) such that the thickness of the resulting coating film was 5.0 μm after being dried and subsequently drying the coating film. Thus, a recording medium of Example 1-24 was prepared.

Example 1-25

A recording medium of Example 1-25 was prepared as in Example 1-23, except that the amount of coating liquid B1 deposited was changed such that the thickness of the resulting coating film was 0.5 μm after being dried.

Example 1-26

A recording medium of Example 1-26 was prepared as in Example 1-23, except that the amount of coating liquid B1 deposited was changed such that the thickness of the resulting coating film was 1.0 μm after being dried.

Example 1-27

A recording medium of Example 1-27 was prepared as in Example 1-23, except that the amount of coating liquid B1 deposited was changed such that the thickness of the resulting coating film was 9.0 μm after being dried.

Example 1-28

A recording medium of Example 1-28 was prepared as in Example 1-23, except that the amount of coating liquid B1 deposited was changed such that the thickness of the resulting coating film was 10.0 μm after being dried.

Comparative Example 1-1

A recording medium of Comparative Example 1-1 was prepared as in Example 1-1, except that the emulsion added to the coating liquid A1 was changed to "Sumikaflex 808HQ" produced by Sumitomo Chemical Co., Ltd. (glass transition temperature: 25° C., ethylene-vinyl acetate-vinyl chloride copolymer emulsion).

Comparative Example 1-2

A recording medium of Comparative Example 1-2 was prepared as in Example 1-1, except that the emulsion added to the coating liquid A1 was changed to "Superflex 860" produced by DKS Co. Ltd. (glass transition temperature 36° C.; urethane resin emulsion).

Comparative Example 1-3

A recording medium of Comparative Example 1-3 was prepared as in Example 1-1, except that the alumina sol added to the coating liquid A1 was changed to the gel-method silica sol.

Comparative Example 1-4

A recording medium of Comparative Example 1-4 was prepared as in Example 1-1, except that the amounts of polyvinyl alcohol and ethylene-vinyl acetate resin emulsion added to the coating liquid A1 in terms of solid content were changed to 7 parts and 16 parts, respectively.

Comparative Example 1-5

A recording medium of Comparative Example 1-5 was prepared as in Example 1-1, except that the amounts of polyvinyl alcohol and ethylene-vinyl acetate resin emulsion added to the coating liquid A1 in terms of solid content were changed to 11 parts and 12 parts, respectively.

Comparative Example 1-6

A recording medium of Comparative Example 1-6 was prepared as in Example 1-1, except that the amounts of polyvinyl alcohol and ethylene-vinyl acetate resin emulsion added to the coating liquid A1 in terms of solid content were changed to 3 parts and 20 parts, respectively.

TABLE 1

| Conditions under which recording media were prepared | | | | | | | | |
|---|---|---|---|---|---|---|---|---|
| | | | First ink receiving layer | | | | | |
| | Substrate | | | First resin | | Second resin | | |
| Example No. | Type | Ra (μm) | Inorganic particles | Type | Content (part) | Type | Tg (° C.) | Content (part) |
| Example 1-1 | Substrate A | 0.1 | Hydrated alumina | PVA235 | 15 | Sumikaflex 410HQ | −18 | 20 |
| Example 1-2 | Substrate A | 0.1 | Hydrated alumina | PVA235 | 15 | Sumikaflex 355HQ | 7 | 20 |
| Example 1-3 | Substrate A | 0.1 | Hydrated alumina | PVA235 | 15 | Sumikaflex 470HQ | 0 | 20 |
| Example 1-4 | Substrate A | 0.1 | Hydrated alumina | PVA235 | 15 | Sumikaflex 752 | 15 | 20 |
| Example 1-5 | Substrate A | 0.1 | Hydrated alumina | PVA235 | 15 | Superflex E2000 | −40 | 20 |
| Example 1-6 | Substrate A | 0.1 | Hydrated alumina | PVA235 | 15 | Sumikaflex 410HQ | −18 | 20 |
| Example 1-7 | Substrate A | 0.1 | Hydrated alumina | PVA235 | 15 | Sumikaflex 410HQ | −18 | 20 |
| Example 1-8 | Substrate A | 0.1 | Hydrated alumina | PVA235 | 15 | Sumikaflex 410HQ | −18 | 20 |
| Example 1-9 | Substrate A | 0.1 | Hydrated alumina | PVA235 | 15 | Sumikaflex 410HQ | −18 | 20 |
| Example 1-10 | Substrate A | 0.1 | Hydrated alumina | PVA235 | 8 | Sumikaflex 410HQ | −18 | 17 |
| Example 1-11 | Substrate A | 0.1 | Hydrated alumina | PVA235 | 5 | Sumikaflex 410HQ | −18 | 25 |
| Example 1-12 | Substrate A | 0.1 | Hydrated alumina | PVA235 | 45 | Sumikaflex 410HQ | −18 | 20 |
| Example 1-13 | Substrate A | 0.1 | Hydrated alumina | PVA235 | 15 | Sumikaflex 410HQ | −18 | 15 |
| Example 1-14 | Substrate A | 0.1 | Hydrated alumina | PVA235 | 15 | Sumikaflex 410HQ | −18 | 60 |
| Example 1-15 | Substrate B | 0.1 | Hydrated alumina | PVA235 | 15 | Sumikaflex 410HQ | −18 | 20 |
| Example 1-16 | Substrate C | 1.5 | Hydrated alumina | PVA235 | 15 | Sumikaflex 410HQ | −18 | 20 |
| Example 1-17 | Substrate D | 2.9 | Hydrated alumina | PVA235 | 15 | Sumikaflex 410HQ | −18 | 20 |
| Example 1-18 | Substrate E | 3.5 | Hydrated alumina | PVA235 | 15 | Sumikaflex 410HQ | −18 | 20 |
| Example 1-19 | Substrate F | 4.8 | Hydrated alumina | PVA235 | 15 | Sumikaflex 410HQ | −18 | 20 |

TABLE 1-continued

| Conditions under which recording media were prepared | | | | | | | | |
|---|---|---|---|---|---|---|---|---|
| Example 1-20 | Substrate G | 6.2 | Hydrated alumina | PVA235 | 15 | Sumikaflex 410HQ | −18 | 20 |
| Example 1-21 | Substrate A | 0.1 | Hydrated alumina | Poly-vinyl-acetamide | 15 | Sumikaflex 410HQ | −18 | 20 |
| Example 1-22 | Substrate A | 0.1 | Hydrated alumina | PVA224 | 15 | Sumikaflex 410HQ | −18 | 20 |
| Example 1-23 | Substrate A | 0.1 | Hydrated alumina | PVA235 | 15 | Sumikaflex 410HQ | −18 | 20 |
| Example 1-24 | Substrate A | 0.1 | Hydrated alumina | PVA235 | 15 | Sumikaflex 410HQ | −18 | 20 |
| Example 1-25 | Substrate A | 0.1 | Hydrated alumina | PVA235 | 15 | Sumikaflex 410HQ | −18 | 20 |
| Example 1-26 | Substrate A | 0.1 | Hydrated alumina | PVA235 | 15 | Sumikaflex 410HQ | −18 | 20 |
| Example 1-27 | Substrate A | 0.1 | Hydrated alumina | PVA235 | 15 | Sumikaflex 410HQ | −18 | 20 |
| Example 1-28 | Substrate A | 0.1 | Hydrated alumina | PVA235 | 15 | Sumikaflex 410HQ | −18 | 20 |
| Comparative example 1-1 | Substrate A | 0.1 | Hydrated alumina | PVA235 | 15 | Sumikaflex 808HQ | 25 | 20 |
| Comparative example 1-2 | Substrate A | 0.1 | Hydrated alumina | PVA235 | 15 | Sumikaflex 860 | 36 | 20 |
| Comparative example 1-13 | Substrate A | 0.1 | Wet-process silica | PVA235 | 15 | Sumikaflex 410HQ | −18 | 20 |
| Comparative example 1-4 | Substrate A | 0.1 | Hydrated alumina | PVA235 | 7 | Sumikaflex 410HQ | −18 | 16 |
| Comparative example 1-5 | Substrate A | 0.1 | Hydrated alumina | PVA235 | 11 | Sumikaflex 410HQ | −18 | 12 |
| Comparative example 1-6 | Substrate A | 0.1 | Hydrated alumina | PVA235 | 3 | Sumikaflex 410HQ | −18 | 20 |

| | First ink receiving layer | | Second ink receiving layer | | | | |
|---|---|---|---|---|---|---|---|
| | | | Water-soluble resin | | Coating | | Ra of recording |
| Example No. | Resin content (part) | Thickness (μm) | Type | Content (part) | liquid Type | Thickness (μm) | medium (μm) |
| Example 1-1 | 35 | 25.0 | — | — | — | 0 | 0.08 |
| Example 1-2 | 35 | 25.0 | — | — | — | 0 | 0.08 |
| Example 1-3 | 35 | 25.0 | — | — | — | 0 | 0.08 |
| Example 1-4 | 35 | 25.0 | — | — | — | 0 | 0.08 |
| Example 1-5 | 35 | 25.0 | — | — | — | 0 | 0.08 |
| Example 1-6 | 35 | 17.0 | — | — | — | 0 | 0.08 |
| Example 1-7 | 35 | 20.0 | — | — | — | 0 | 0.08 |
| Example 1-8 | 35 | 35.0 | — | — | — | 0 | 0.08 |
| Example 1-9 | 35 | 37.0 | — | — | — | 0 | 0.08 |
| Example 1-10 | 25 | 25.0 | — | — | — | 0 | 0.08 |
| Example 1-11 | 30 | 25.0 | — | — | — | 0 | 0.08 |
| Example 1-12 | 65 | 25.0 | — | — | — | 0 | 0.08 |
| Example 1-13 | 30 | 25.0 | — | — | — | 0 | 0.08 |
| Example 1-14 | 75 | 25.0 | — | — | — | 0 | 0.08 |
| Example 1-15 | 35 | 25.0 | — | — | — | 0 | 0.90 |

TABLE 1-continued

| Conditions under which recording media were prepared | | | | | | | |
|---|---|---|---|---|---|---|---|
| Example 1-16 | 35 | 25.0 | — | — | — | 0 | 1.20 |
| Example 1-17 | 35 | 25.0 | — | — | — | 0 | 2.40 |
| Example 1-18 | 35 | 25.0 | — | — | — | 0 | 2.80 |
| Example 1-19 | 35 | 25.0 | — | — | — | 0 | 4.10 |
| Example 1-20 | 35 | 25.0 | — | — | — | 0 | 5.20 |
| Example 1-21 | 35 | 25.0 | — | — | — | 0 | 0.08 |
| Example 1-22 | 35 | 25.0 | — | — | — | 0 | 0.08 |
| Example 1-23 | 35 | 25.0 | PVA235 | 23 | B1 | 5.0 | 0.08 |
| Example 1-24 | 35 | 25.0 | PVA235 | 5 | B2 | 5.0 | 0.08 |
| Example 1-25 | 35 | 25.0 | PVA235 | 23 | B1 | 0.5 | 0.08 |
| Example 1-26 | 35 | 25.0 | PVA235 | 23 | B1 | 1.0 | 0.08 |
| Example 1-27 | 35 | 25.0 | PVA235 | 23 | B1 | 9.0 | 0.08 |
| Example 1-28 | 35 | 25.0 | PVA235 | 23 | B1 | 10.0 | 0.08 |
| Comparative example 1-1 | 35 | 25.0 | — | — | — | 0 | 0.08 |
| Comparative example 1-2 | 35 | 25.0 | — | — | — | 0 | 0.08 |
| Comparative example 1-13 | 35 | 25.0 | — | — | — | 0 | 0.08 |
| Comparative example 1-4 | 23 | 25.0 | — | — | — | 0 | 0.08 |
| Comparative example 1-5 | 23 | 25.0 | — | — | — | 0 | 0.08 |
| Comparative example 1-6 | 23 | 25.0 | — | — | — | 0 | 0.08 |

Evaluations

Fold Crack Resistance of Recording Medium

The recording media prepared above were each formed into an A4-size sheet. A black solid image was formed over the entire recording surface of each recording medium using an ink-jet printer "MP990" produced by CANON KABUSHIKI KAISHA. The resulting recording media were each folded in half such that the recording surface came inside. While a load of 500 kg was applied to the folded recording media with a pressing machine, the recording media were maintained for 5 minutes. Subsequently, the folded portion of each recording medium was visually inspected and evaluated in accordance with the following criteria. Table 2 summarizes the results.

A: White line was hardly observed.

B: White line was slightly observed.

C: White line was observed to some extent.

D: White line was observed clearly.

E: Thick white line was observed clearly.

Ink Absorbency of Recording Medium

A green solid image was formed on the recording surface of each recording medium by using an ink-jet printer "MP990" produced by CANON KABUSHIKI KAISHA (photo paper: Glossy Gold, color correction: None). Each solid image was visually inspected and evaluated in accordance with the following criteria. Table 2 summarizes the results.

A: Color unevenness was hardly observed on the solid image.

B: Color unevenness was slightly observed on the solid image.

C: Color unevenness was observed to some extent on the solid image.

Image Density

A black solid image was formed on the recording surface of each recording medium by using an ink-jet printer "MP990" produced by CANON KABUSHIKI KAISHA (photo paper: Glossy Gold, color correction: None). The optical density of each solid image was measured by using an optical reflection densitometer "530 Spectrodensitometer" produced by X-Rite, Inc. and evaluated in accordance with the following criteria. Table 2 summarizes the results.

A: The optical density of the solid image was 2.0 or more.

B: The optical density of the solid image was 1.9 or more and less than 2.0.

C: The optical density of the solid image was 1.8 or more and less than 1.9.

D: The optical density of the solid image was 1.7 or more and less than 1.8.

E: The optical density of the solid image was less than 1.7.

Reduction in Occurrence of Fogging

For each of Examples and Comparative Examples, two recording media were prepared, and the images 1 and 2 described below were formed on the respective recording media by using an ink-jet photo printer "PIXUS MP990" produced by CANON KABUSHIKI KAISHA in "Glossy Gold" mode (normal configuration, color/density: No matching). Thus, a recording medium on which the image 1 was formed and a recording medium on which the image 2 was formed were prepared.

Image 1: A 15-centimeter-square pattern filled in (R, G, B)=(0, 0, 0) in the RGB mode of "PhotoShop 7.0".

Image 2: A 5-centimeter-square pattern filled in (R, G, B)=(255, 255, 0) in the ROB mode of "PhotoShop 7.0".

The recording medium on which the image 1 was formed and the recording medium on which the image 2 was formed were stored for 30 minutes at 23° C. and 50% RH. Then, the two recording media were brought into contact with each other such that the region in which the image 1 was formed and the region in which the image 2 was formed were superimposed on each other and stored for 24 hours. Subsequently, in the region of the recording medium in which the image 1 was formed, the portion that was brought into contact with the image 2 and the portion that was not brought into contact with the image 2 were visually inspected and evaluated in accordance with the following criteria. Table 2 summarizes the results.

A: The difference between the portion of the image 1 which was not brought into contact with the image 2 and the portion of the image 1 which was brought into contact with the image 2 was hardly observed (i.e., fogging was hardly observed at the portion of the image 1 which was brought into contact with the image 2).

B: The portion of the image 1 which was brought into contact with the image 2 was slightly washed out compared with the portion of the image 1 which was not brought into contact with the image 2 (i.e., fogging was slightly observed at the portion of the image 1 which was brought into contact with the image 2).

C: The portion of the image 1 which was brought into contact with the image 2 was washed out compared with the portion of the image 1 which was not brought into contact with the image 2 (i.e., fogging was observed at the portion of the image 1 which was brought into contact with the image 2).

D: The portion of the image 1 which was brought into contact with the image 2 was washed out significantly compared with the portion of the image 1 which was not brought into contact with the image 2 (i.e., fogging was significantly observed at the portion of the image 1 which was brought into contact with the image 2).

TABLE 2

| Evaluation results | | | | |
|---|---|---|---|---|
| Example No. | Fold crack resistance | Ink absorbency | Image density | Reduction in occurrence of fogging |
| Example 1-1 | A | B | B | C |
| Example 1-2 | A | B | B | C |
| Example 1-3 | B | B | B | C |
| Example 1-4 | C | B | B | C |
| Example 1-5 | B | B | B | C |
| Example 1-6 | A | C | C | D |
| Example 1-7 | A | C | B | D |
| Example 1-8 | B | B | B | C |
| Example 1-9 | C | B | B | C |
| Example 1-10 | C | B | B | C |
| Example 1-11 | B | B | B | C |
| Example 1-12 | A | C | B | C |
| Example 1-13 | B | B | B | C |

TABLE 2-continued

| Evaluation results | | | | |
|---|---|---|---|---|
| Example No. | Fold crack resistance | Ink absorbency | Image density | Reduction in occurrence of fogging |
| Example 1-14 | A | C | B | C |
| Example 1-15 | A | B | B | A |
| Example 1-16 | A | B | B | A |
| Example 1-17 | A | B | B | A |
| Example 1-18 | B | B | B | A |
| Example 1-19 | B | B | B | A |
| Example 1-20 | C | B | B | A |
| Example 1-21 | C | B | B | C |
| Example 1-22 | C | B | B | C |
| Example 1-23 | A | A | A | D |
| Example 1-24 | A | A | A | B |
| Example 1-25 | A | B | C | C |
| Example 1-26 | A | B | B | C |
| Example 1-27 | B | A | A | B |
| Example 1-28 | C | A | A | B |
| Comparative example 1-1 | D | B | C | C |
| Comparative example 1-2 | E | B | C | C |
| Comparative example 1-3 | E | B | E | C |
| Comparative example 1-4 | D | A | B | C |
| Comparative example 1-5 | E | A | B | C |
| Comparative example 1-6 | D | A | B | C |

Example 2-1

Preparation of Coating Liquid A2 Used for Forming Ink Receiving Layer (A)

The aqueous polyvinyl alcohol solution prepared above was mixed with the alumina sol prepared above such that the amount of polyvinyl alcohol was 15 parts in terms of sold content relative to 100 parts of alumina included in the alumina sol. To the resulting liquid mixture, a urethane resin emulsion "Superflex E2000" produced by DKS Co. Ltd. (particle diameter: 0.64 μm, elongation: 1350%) was added such that the amount of urethane resin was 30 parts in terms of solid content relative to 100 parts of alumina included in the liquid mixture. To the liquid mixture, subsequently, an aqueous solution of orthoboric acid having a solid density of 5% by mass was further added such that the amount of orthoboric acid was 0.75 parts relative to 100 parts of alumina included in the liquid mixture in terms of solid content. Thus, a coating liquid A2 was prepared.

Preparation of Coating Liquid B3 Used for Forming Ink Receiving Layer (B)

The aqueous polyvinyl alcohol solution prepared above was mixed with the alumina sol prepared above such that the amount of polyvinyl alcohol was 9 parts in terms of solid content relative to 100 parts of alumina included in the alumina sol. To the resulting liquid mixture, an aqueous solution of orthoboric acid having a solid density of 5% by mass was added such that the amount of orthoboric acid was 1 part relative to 100 parts of alumina included in the liquid mixture in terms of solid content. Thus, a coating liquid B3 was prepared.

Preparation of Recording Medium

A recording medium of Example 2-1 was prepared by applying the coating liquid A2 onto one surface of the substrate A such that the thickness of the resulting coating film was 25 μm after being dried and subsequently drying the coating film.

Examples 2-2 to 2-22 and Comparative Examples 2-1 to 2-8

Recording media of Examples 2-2 to 2-22 and recording media of Comparative Examples 2-1 to 2-8 were prepared as in Example 2-1, except that the types and amounts of the resins (1) and (2) added to the coating liquid A2 used for preparing the ink receiving layer (A) and the coating liquid B3 used for preparing the ink receiving layer (B) and the thickness of the ink receiving layer were changed as described in Table 3.

Evaluations

In the evaluations below, "5" to "2" mean that the results were at an acceptable level, and "1" means that the results were at an unacceptable level.

Fold Crack Resistance of Recording Medium Bent Repeatedly

The recording media prepared above were each formed into an A4-size sheet. A black solid image was formed over the entire recording surface of each recording medium by using an ink-jet printer "MP990" produced by CANON KABUSHIKI KAISHA. The resulting recording media were each folded in half such that the recording surface came inside. While a load of 500 kg was applied to the folded recording media with a pressing machine, the recording media were maintained for 5 minutes. Subsequently, the recording media were each opened and closed repeatedly 100 times. Then, the folded portion of each recording medium was visually inspected and evaluated in accordance with the following criteria. Table 4 summarizes the results.

5: White line was hardly observed.

4: White line was slightly observed.

3: White line was observed to some extent.

2: White line was observed clearly.

1: Thick white line was observed clearly.

Ink Absorbency

A green solid image was formed on the recording surface of each recording medium by using an ink-jet printer "MP990" produced by CANON KABUSHIKI KASHA (photo paper: Glossy Gold, color correction: None). Each solid image was visually inspected and evaluated in accordance with the following criteria. Table 4 summarizes the results.

5: Color unevenness was hardly observed on the solid image.

4: Color unevenness was slightly observed on the solid image.

3: Color unevenness was observed to some extent on the solid image.

2: Color unevenness was considerably observed on the solid image.

1: Spillover of ink was observed on the solid image.

TABLE 3

| | Ink receiving layer (A) | | | | | | | |
|---|---|---|---|---|---|---|---|---|
| | Inorganic particles | a) Resin (1) | | | b) Resin (2) | | | |
| | Product name | Type | Degree of polymerization | Number of parts | Type | Product name | μm | % |
| Example 2-1 | DISPERAL HP14 | PVA | 3500 | 15 | Urethane | Superflex E2000 | 0.64 | 1350 |
| Example 2-2 | DISPERAL HP14 | PVA | 3500 | 15 | Urethane | BONTIGHTER HU830 | 0.38 | 900 |
| Example 2-3 | DISPERAL HP14 | PVA | 3500 | 15 | Urethane | VONDIC 1940NE | 0.46 | 750 |
| Example 2-4 | DISPERAL HP14 | PVA | 3500 | 5 | Urethane | Superflex E2000 | 0.64 | 1350 |
| Example 2-5 | DISPERAL HP14 | Polyvinyl-acetamide | — | 15 | Urethane | Superflex E2000 | 0.64 | 1350 |
| Example 2-6 | DISPERAL HP14 | PVA | 3500 | 3 | Urethane | Superflex E2000 | 0.64 | 1350 |
| Example 2-7 | DISPERAL HP14 | PVA | 3500 | 5 | Urethane | Superflex E2000 | 0.64 | 1350 |
| Example 2-8 | DISPERAL HP14 | PVA | 3500 | 35 | Urethane | Superflex E2000 | 0.64 | 1350 |
| Example 2-9 | DISPERAL HP14 | PVA | 3500 | 37 | Urethane | Superflex E2000 | 0.64 | 1350 |
| Example 2-10 | DISPERAL HP14 | PVA | 3500 | 15 | Urethane | Superflex E2000 | 0.64 | 1350 |
| Example 2-11 | DISPERAL HP14 | PVA | 3500 | 15 | Urethane | Superflex E2000 | 0.64 | 1350 |
| Example 2-12 | DISPERAL HP14 | PVA | 3500 | 15 | Urethane | Superflex E2000 | 0.64 | 1350 |
| Example 2-13 | DISPERAL HP14 | PVA | 3500 | 15 | Urethane | Superflex E2000 | 0.64 | 1350 |
| Example 2-14 | DISPERAL HP14 | PVA | 3500 | 15 | Urethane | Superflex E2000 | 0.64 | 1350 |
| Example 2-15 | DISPERAL HP14 | PVA | 3500 | 15 | Urethane | Superflex E2000 | 0.64 | 1350 |
| Example 2-16 | DISPERAL HP14 | PVA | 3500 | 15 | Urethane | Superflex E2000 | 0.64 | 1350 |
| Example 2-17 | DISPERAL HP14 | PVA | 3500 | 15 | Urethane | Superflex E2000 | 0.64 | 1350 |
| Example 2-18 | DISPERAL HP14 | PVA | 3500 | 15 | EVA | Sumikaflex 201HQ | 0.78 | 1000 |

TABLE 3-continued

| | | | | | | | | |
|---|---|---|---|---|---|---|---|---|
| Example 2-19 | DISPERAL HP14 | PVA | 1700 | 15 | Urethane | Superflex E2000 | 0.64 | 1350 |
| Example 2-20 | DISPERAL HP14 | PVA | 3500 | 15 | Urethane | Superflex E2000 | 0.64 | 1350 |
| Example 2-21 | DISPERAL HP14 | PVA | 3500 | 15 | Urethane | Superflex E2000 | 0.64 | 1350 |
| Example 2-22 | DISPERAL HP14 | PVA | 3500 | 15 | Urethane | Superflex E2000 | 0.64 | 1350 |
| Comparative example 2-1 | DISPERAL HP14 | PVA | 3500 | 15 | Urethane | Superflex E4800 | 0.20 | 720 |
| Comparative example 2-2 | DISPERAL HP14 | PVA | 3500 | 15 | Urethane | VONDIC 1980NE | 0.50 | 160 |
| Comparative example 2-3 | DISPERAL HP14 | PVA | 3500 | 15 | Urethane | VONDIC 8510 | 0.83 | 500 |
| Comparative example 2-4 | DISPERAL HP14 | PVA | 3500 | 5 | Urethane | Superflex E2000 | 0.64 | 1350 |
| Comparative example 2-5 | DISPERAL HP14 | PVA | 3500 | 3 | Urethane | Superflex E2000 | 0.64 | 1350 |
| Comparative example 2-6 | DISPERAL HP14 | PVA | 3500 | 35 | Urethane | Superflex E2000 | 0.64 | 1350 |
| Comparative example 2-7 | DISPERAL HP14 | — | — | 0 | Urethane | Superflex E2000 | 0.64 | 1350 |
| Comparative example 2-8 | DISPERAL HP14 | PVA | 3500 | 20 | Urethane | — | — | — |

| | Ink receiving layer (A) | | | Ink receiving layer (B) | | | | |
|---|---|---|---|---|---|---|---|---|
| | b) Resin 2 | a) + b) | | Inorganic particles | Water-soluble resin | | | Total |
| | Number of parts | Number of parts | Thickness μm | Product name | Type | Number of parts | Thickness μm | thickness μm |
| Example 2-1 | 30 | 45 | 25 | — | — | — | — | 25 |
| Example 2-2 | 30 | 45 | 25 | — | — | — | — | 25 |
| Example 2-3 | 30 | 45 | 25 | — | — | — | — | 25 |
| Example 2-4 | 15 | 20 | 25 | — | — | — | — | 25 |
| Example 2-5 | 30 | 45 | 25 | — | — | — | — | 25 |
| Example 2-6 | 30 | 33 | 25 | — | — | — | — | 25 |
| Example 2-7 | 30 | 35 | 25 | — | — | — | — | 25 |
| Example 2-8 | 30 | 65 | 25 | — | — | — | — | 25 |
| Example 2-9 | 30 | 67 | 25 | — | — | — | — | 25 |
| Example 2-10 | 13 | 28 | 25 | — | — | — | — | 25 |
| Example 2-11 | 15 | 30 | 25 | — | — | — | — | 25 |
| Example 2-12 | 60 | 75 | 25 | — | — | — | — | 25 |
| Example 2-13 | 62 | 77 | 25 | — | — | — | — | 25 |
| Example 2-14 | 30 | 45 | 13 | — | — | — | — | 13 |
| Example 2-15 | 30 | 45 | 15 | — | — | — | — | 15 |
| Example 2-16 | 30 | 45 | 35 | — | — | — | — | 35 |
| Example 2-17 | 30 | 45 | 37 | — | — | — | — | 37 |
| Example 2-18 | 30 | 45 | 25 | — | — | — | — | 25 |
| Example 2-19 | 30 | 45 | 25 | — | — | — | — | 25 |
| Example 2-20 | 30 | 45 | 25 | DISPERAL HP14 | PVA | 11 | 1 | 26 |
| Example 2-21 | 30 | 45 | 25 | DISPERAL HP14 | PVA | 11 | 5 | 30 |
| Example 2-22 | 30 | 45 | 25 | DISPERAL HP14 | PVA | 11 | 10 | 35 |
| Comparative example 2-1 | 30 | 45 | 25 | — | — | — | — | 25 |
| Comparative example 2-2 | 30 | 45 | 25 | — | — | — | — | 25 |
| Comparative example 2-3 | 30 | 45 | 25 | — | — | — | — | 25 |
| Comparative example 2-4 | 12 | 17 | 25 | — | — | — | — | 25 |
| Comparative example 2-5 | 15 | 18 | 25 | — | — | — | — | 25 |
| Comparative example 2-6 | 60 | 95 | 25 | — | — | — | — | 25 |
| Comparative example 2-7 | 20 | 20 | 25 | — | — | — | — | 25 |
| Comparative example 2-8 | 0 | 20 | 25 | — | — | — | — | 25 |

TABLE 4

| | Evaluation results | |
|---|---|---|
| | Fold crack resistance | Ink absorbency |
| Example 2-1 | 5 | 4 |
| Example 2-2 | 4 | 4 |
| Example 2-3 | 3 | 4 |
| Example 2-4 | 3 | 4 |
| Example 2-5 | 2 | 4 |
| Example 2-6 | 2 | 4 |
| Example 2-7 | 3 | 4 |
| Example 2-8 | 5 | 3 |
| Example 2-9 | 5 | 2 |
| Example 2-10 | 2 | 4 |
| Example 2-11 | 3 | 4 |
| Example 2-12 | 5 | 3 |
| Example 2-13 | 5 | 2 |
| Example 2-14 | 5 | 2 |
| Example 2-15 | 5 | 3 |
| Example 2-16 | 3 | 4 |
| Example 2-17 | 2 | 4 |
| Example 2-18 | 2 | 4 |
| Example 2-19 | 2 | 4 |
| Example 2-20 | 5 | 5 |
| Example 2-21 | 5 | 5 |
| Example 2-22 | 3 | 5 |
| Comparative example 2-1 | 1 | 4 |
| Comparative example 2-2 | 1 | 4 |
| Comparative example 2-3 | 1 | 4 |
| Comparative example 2-4 | 1 | 4 |
| Comparative example 2-5 | 1 | 4 |
| Comparative example 2-6 | 5 | 1 |
| Comparative example 2-7 | 1 | 4 |
| Comparative example 2-8 | 1 | 4 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-040474, filed Mar. 2, 2015 and No. 2016-031241 filed Feb. 22, 2016, which are hereby incorporated by reference herein in their entirety.

What is claimed is:

1. A recording medium comprising:

a substrate; and an ink receiving layer on the substrate, the ink receiving layer including inorganic particles, and a binder, the inorganic particles including at least one type of alumina particles selected from fumed alumina particles and hydrated alumina particles, the binder including a water-soluble resin (1), and a polyurethane resin (2) having an average particle diameter of 0.3 μm or more and an elongation of 550% or more, the total amount of the resin (1) and the resin (2) included in the ink receiving layer being 20% by mass or more and 50% by mass or less of the content of the alumina particles included in the ink receiving layer.

2. The recording medium according to claim 1, further comprising a second ink receiving layer disposed on the ink receiving layer on a side opposite to the side on which the substrate is disposed, the second ink receiving layer including inorganic particles and polyvinyl alcohol, the second ink receiving layer not including a resin having a glass transition temperature of 20° C. or less.

3. The recording medium according to claim 1, wherein the second ink receiving layer has a thickness of 1 μm or more and 9 μm or less.

* * * * *